United States Patent [19]

Lee

[11] Patent Number: 4,749,195

[45] Date of Patent: Jun. 7, 1988

[54] FISHING-OCTOPUS TOYS

[76] Inventor: Ching H. Lee, 14,Hsin Ping Rd., Tainan City, Taiwan

[21] Appl. No.: 27,261

[22] Filed: Mar. 18, 1987

[51] Int. Cl.[4] ..... A63F 9/00

[52] U.S. Cl. ..... 273/1 GE; 273/1 GG

[58] Field of Search ..... 273/1 GE, 1 GG, 1 GD, 273/1 G, 140

[56] References Cited

U.S. PATENT DOCUMENTS

| | | | |
|---|---|---|---|
| 3,951,405 | 4/1976 | Long | 273/1 GG |
| 4,214,750 | 7/1980 | Shimizu | 273/1 GD |
| 4,298,199 | 11/1981 | Bush et al. | 273/1 GG X |
| 4,310,156 | 1/1982 | Kulesza et al. | 273/1 GE |
| 4,524,967 | 6/1985 | Hanson et al. | 273/1 GE |
| 4,603,860 | 8/1986 | Wey | 273/1 GD |

*Primary Examiner*—Paul E. Shapiro

*Attorney, Agent, or Firm*—Holman & Stern

[57] ABSTRACT

This toy includes a round plate able to be turned around, and round holes are set on the surface of the plate for setting in an octopus in each hole; the octopus can be raised up or lowered down by a rising-up-and-down rail at the hole bottom for a player to fish it up with a cage fastened with a fishing rod while the plate is turning around and the octopus is raised up.

3 Claims, 5 Drawing Sheets

FISHING-OCTOPUS TOYS

BACKGROUND OF THE INVENTION

This invention concerns a kind of a toy for children in fishing an octopus.

One of conventional fishing toys generally has a round plate equipped with a plurality of round holes on its surface; the plate can be turned around with a toy fish put in each hole; as the plate is turning around, the toy fish gradually rises up with its mouth also gradually opening; then a player uses a fishing rod fastened with a string whose tip is tied with a round ball, trying to place the round ball to be stuck in the teeth of the mouth of the toy fish and pulling up the toy fish.

Another conventional one is similar to the one just mentioned above, but the head of the toy fish has an iron piece for a magnetic hook of a fishing rod to suck and pull it up.

Nevertheless, those fishing toys do not require so much skill in playing them so that they cannot attract children for a long time to acquire recreation. Then it will be a kind of monetary waste. So the inventory has worked out this fishing-octopus toy that needs a certain degree of skill and practice in playing it in order to tempt children for a rather long time to get recreation in playing it.

SUMMARY OF THE INVENTION

This fishing-octopus toy includes a round plate on which there are round holes for putting in toy octopuses that have a round head and a body. Feet stretch out of the octopus body as the plate is turning around and when the octopus sinks down in the round hole, the feet are bent up around its head so that a player cannot make a cage fastened with a fishing rod envelop its head, in other words, he/she cannot fish up the octopus. But when it rises up and the feet are stretched out and down, the cage can be made to envelop the head, so the octopus can be pulled up.

DETAILED DESCRIPTION OF THE INVENTION

Figure 1:
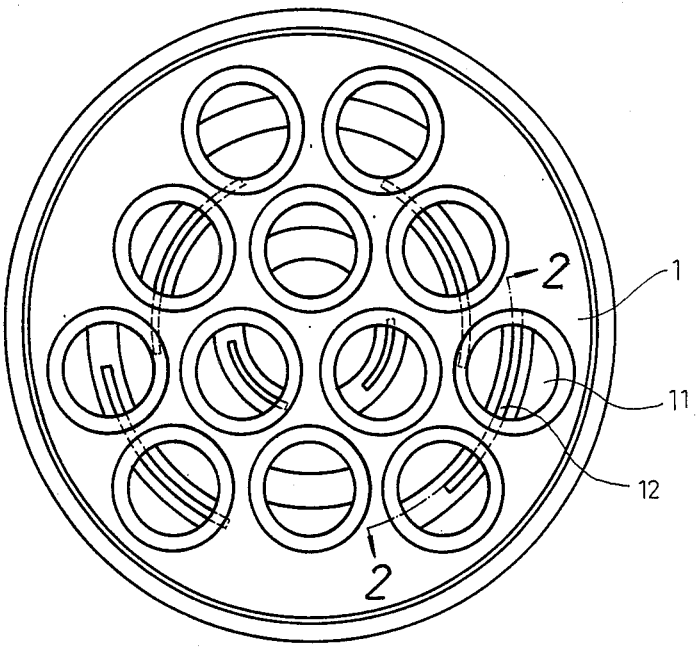
FIG. 1 is a plan view of the round plate in this invention.
Figure 2:
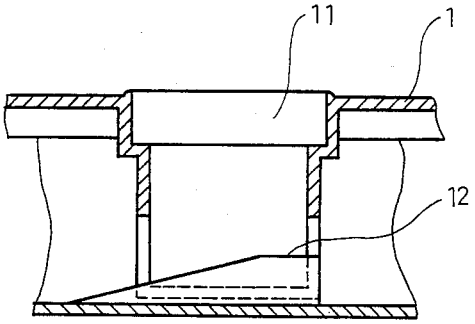
FIG. 2 is a cross-sectional view on line 2—2 of FIG. 1.

FIGS. 1, 2 show the structure of the round plate of this toy that can be turned around, as it is the same as common ones of this kind. There are a plurality of round holes 11 set on the surface of the plate 1, and one octopus 2 can be placed in each hole 11 by means of rising-up-and-down rail 12, which can raise up or down octopus 2 by turning movement of the plate 1.

Figure 3:
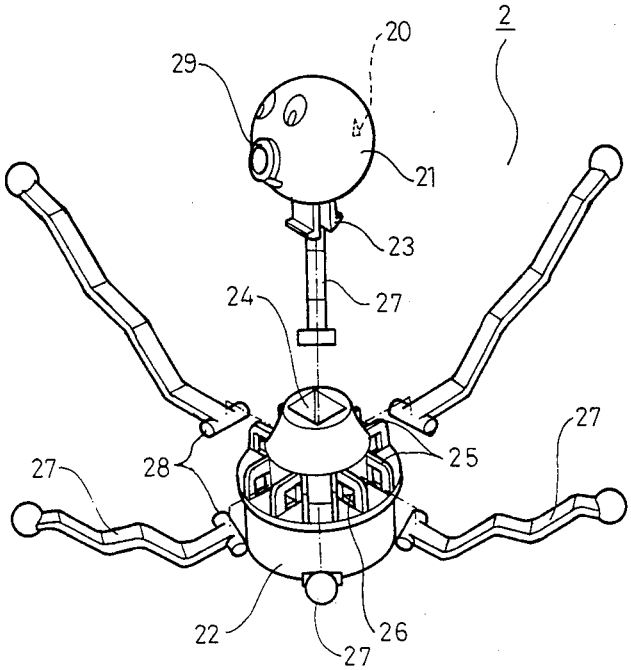
FIG. 3 is an exploded perspective view of the octopus in this invention.
Figure 4:
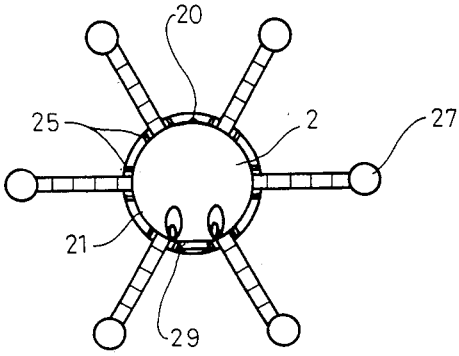
FIG. 4 is a plan view of the octopus in this invention.

Next, FIG. 3 shows the structure of octopus 2, which includes head 21 shaped as a round ball and body 22 of a cylinder form. Head 21 is stuck in hole 24 of body 22 by means of hook 23 stretching down therein. A plurality of vertical walls 25 are set on body 22, and in each wall 25 is provided with shaft hole 26; so that a foot 27 with shaft 28 can be combined with two neighboring walls 25 by inserting shaft 28 into shaft hole 26, and thus foot 27 can move with its shaft 28 functioning as a pivot.

Figure 5:
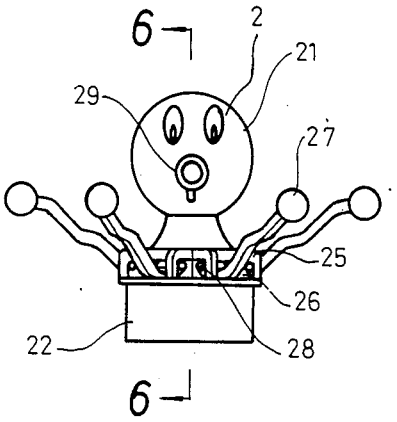
FIG. 5 is a front view of the octopus in this invention.
Figure 6:
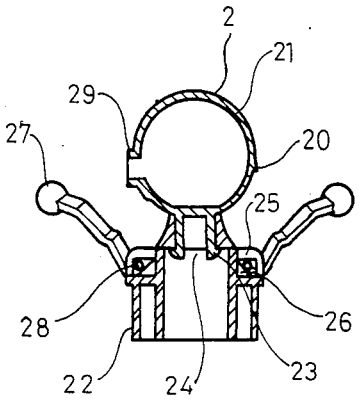
FIG. 6 is a cross-sectional view of the octopus in this invention.

How to assemble octopus 2 is shown in FIGS. 5, 6; feet 27 have a round ball at one of its end and the other end or shaft 28 acts as a pivot, so feet can stretch out and down or be bend up; head 21 has a protruding mouth 29 at its front and protrusion 20 at its rear.

Figure 7:
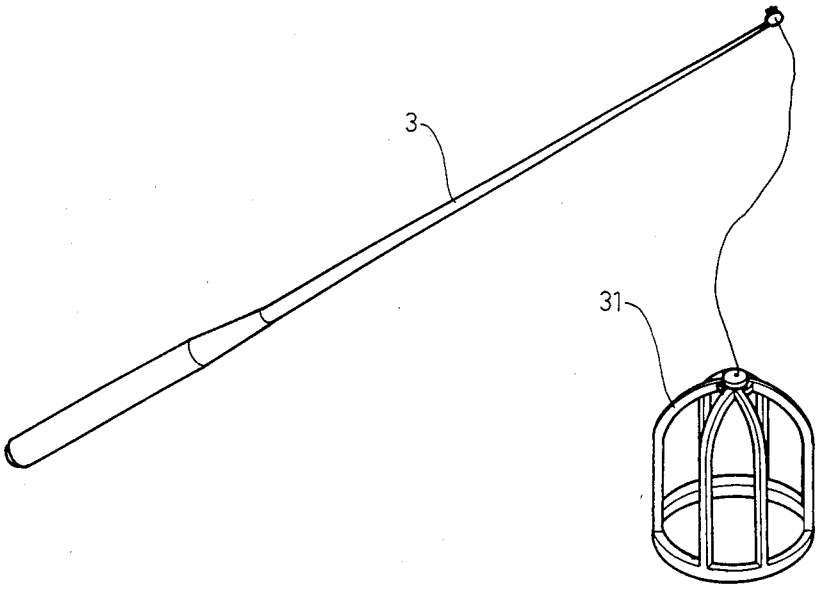
FIG. 7 is a view of the fishing rod in this invention.

FIG. 7 shows the structure of fishing rod 3, which has a string fastened at its tip, and round cage 31 tied with the string. Cage 31 has an underside round opening and the inside diameter of the opening is a little shorter than the longest diameter of head 21; cage 31 cannot envelop head 21 for fishing octopus 2 up unless cage 31 is lowered to hook mouth 29 at first and then protrusion 20, and it requires some degree of skill and practice to fish it up while octopus 2 is being raised up. Otherwise, it moves down again in the hole and cannot be fished up.

Figure 8:
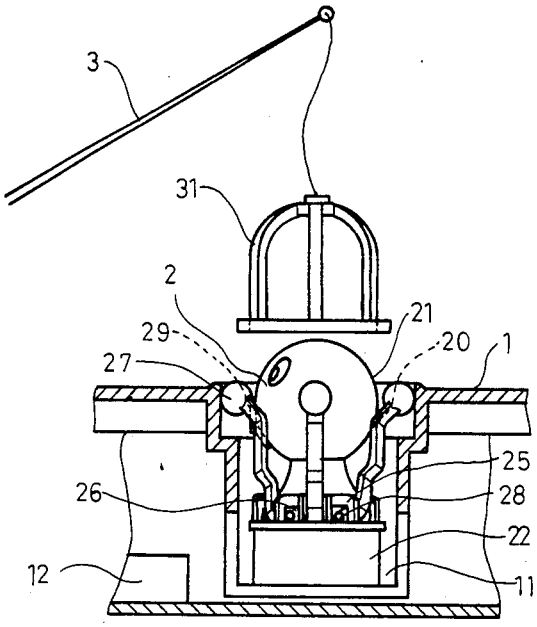
FIG. 8 to 11 are sectional elevational views of the toy in different positions of use.
Figure 9:
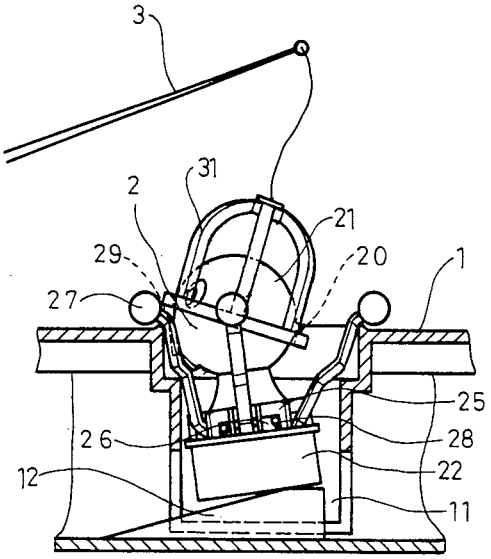
Figure 10:
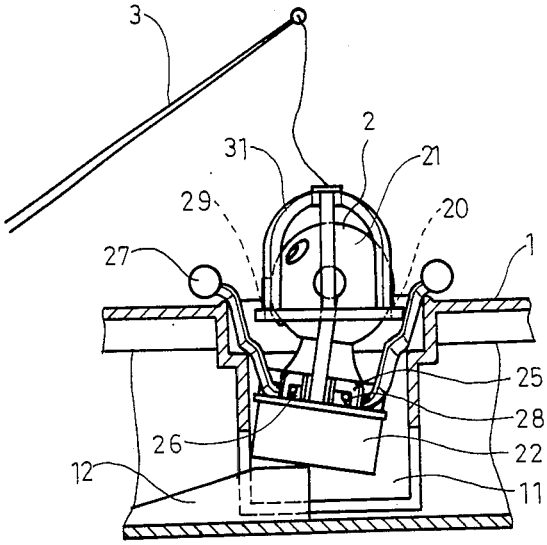
Figure 11:
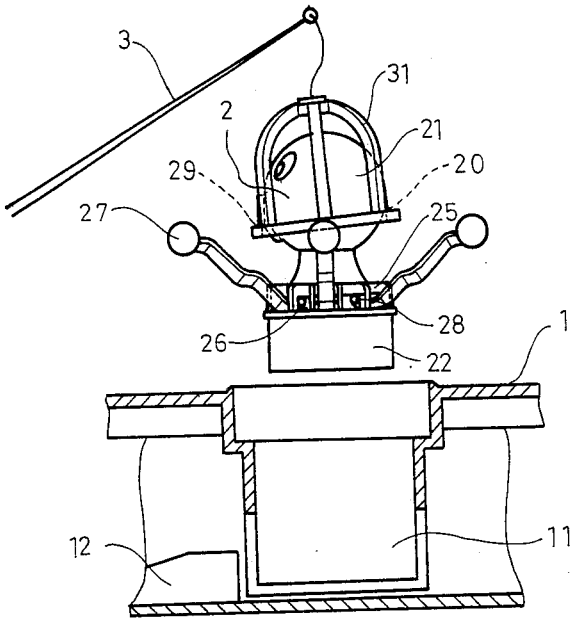

FIG. 8 shows one example of using this toy. When octopus 2 sinks down at the bottom of round hole 11, head 21 is impossible to be enveloped by cage 31 for fishing up octopus 2, because head 21 is surrounded by feet 27 which are bent up. But when octopus 2 is gradually raised up by the rail at the hole bottom with round plate 1 turning around, as FIG. 9 shows, feet 27 are able to stretch out and down and head 21 of octopus 2 is to lean naturally to one side of round hole 11. Then cage 31 has to be lowered for covering, enveloping head 21 and hooking mouth 21 and protrusion 20, but meanwhile head 21 is tilting by the movement of round plate 1, so cage 31 is needed to be adjusted by the player in order to fish up the octopus.

Generally speaking, this new toy possesses a rather complicated structure for fishing, and needs a little skill and practice in playing, otherwise the octopus cannot be easily fished up. Therefore, it can even attract children of older age to play it and give them a feeling of challenge and accomplishment in playing.

What is claimed is:

1. A fishing-octopus toy comprising, a round plate equipped with a plurality of round holes for setting an octopus therein, and able to be turned around so that a rising-up-and-down rail set at the bottom of the round holes may raise up or lower down the octopus in the hole, octopuses made up of a head and a body, which are combined together with a protruding hook of the head hooking in a hole of the body; the head having a mouth in the front and a protrusion tilting downward at the rear; the body having a plurality of walls, which are separately set with a shaft hole for the shaft of a foot to insert in and to be able to move around as a pivot for the foot to stretch out and down or to be bent up, a fishing rod fastened with a string, having an end tied with a cage, whose bottom round opening has a little smaller diameter than the diameter of the largest part of the head, and having the characteristics that, during turning movement of the round plate, when the octopus sinks down at the hole bottom, its feet are bent up close near the head to make it impossible to be covered and enveloped by the cage, and when the octopus is raised up, its feet are stretched out and down to make its head possible to be covered, enveloped, hooked by the cage and fished up by manipulating the cage over the mouth and the protrusion of the head.

2. The fishing-octopus toy as claimed in claim 1, wherein the mouth and the protrusion of the octopus head are set symmetrically at the front and at the rear and protrude downward.

3. The fishing-octopus toy as claimed in claim 1, wherein the inside diameter of the cage bottom is a little longer than that of the octopus head but a little shorter than that of the mouth to the protrusion.

* * * * *